US009669453B2

(12) United States Patent
Freis

(10) Patent No.: US 9,669,453 B2
(45) Date of Patent: Jun. 6, 2017

(54) EXPANDABLE CLINCH JOINT PUNCH

(71) Applicant: Ford Global Technologies, LLC, Dearborn, MI (US)

(72) Inventor: Amanda Kay Freis, Ann Arbor, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 377 days.

(21) Appl. No.: 14/053,197

(22) Filed: Oct. 14, 2013

(65) Prior Publication Data

US 2015/0101170 A1 Apr. 16, 2015

(51) Int. Cl.
*B21D 39/03* (2006.01)

(52) U.S. Cl.
CPC ..... *B21D 39/031* (2013.01); *Y10T 29/49837* (2015.01); *Y10T 29/53996* (2015.01)

(58) Field of Classification Search
CPC ..... Y10T 24/45696; Y10T 24/45743; Y10T 29/49938; Y10T 29/49698
See application file for complete search history.

(56) References Cited

U.S. PATENT DOCUMENTS 3,022,687 A * 2/1962 Richards ..... B21J 15/025 227/51
3,121,282 A * 2/1964 Donee ..... H01R 43/22 29/282
3,934,327 A 1/1976 Hafner
4,208,776 A * 6/1980 Schleicher ..... B21D 39/035 29/21.1
4,468,846 A 9/1984 Rossmann
5,155,897 A 10/1992 Schleicher
5,230,136 A 7/1993 Cronn et al.
5,315,743 A * 5/1994 Schleicher ..... B21D 39/031 29/243.5
5,339,509 A 8/1994 Sawdon et al.
5,408,735 A 4/1995 Schleicher
5,528,815 A 6/1996 Webb
5,622,442 A 4/1997 Schleicher
5,671,953 A * 9/1997 Brewis ..... F16L 33/213 285/258
5,884,386 A * 3/1999 Blacket ..... B21D 39/031 29/432.2
6,286,213 B1 * 9/2001 Hada ..... F02M 35/10144 29/507
6,473,957 B1 11/2002 Voelkner et al.
6,684,479 B2 2/2004 Wang et al.
6,722,146 B2 4/2004 Roh et al.
6,986,301 B2 1/2006 Wade
(Continued)

FOREIGN PATENT DOCUMENTS

CA 2073595 C 10/1995
EP 1249286 B1 7/2005

*Primary Examiner* — Jason L Vaughan
*Assistant Examiner* — Amanda Meneghini
(74) *Attorney, Agent, or Firm* — Damian Porcari; Brooks Kushman P.C.

(57) ABSTRACT

A clinch punch including a core and an sleeve that includes a plurality of teeth for forming an enhanced clinch joint. The core includes a first cam surface that engages cam surfaces on the teeth that drive the teeth into the sides of the clinch joint. In an alternative embodiment, the core acts upon jaws that are driven into engagement with the sides of the clinch joint.

6 Claims, 3 Drawing Sheets

(56) References Cited

U.S. PATENT DOCUMENTS

| | | | | |
|---|---|---|---|---|
| 7,101,169 | B2 | 9/2006 | Fick et al. | |
| 7,581,300 | B2 | 9/2009 | Babej | |
| 7,980,158 | B1 | 7/2011 | Centrella | |
| 8,024,848 | B2 | 9/2011 | Carter | |
| 2002/0166292 | A1* | 11/2002 | Quinn | E04D 1/30 52/58 |
| 2006/0150389 | A1* | 7/2006 | Schwarz | B21D 26/035 29/521 |
| 2010/0018148 | A1 | 1/2010 | Trojer et al. | |

* cited by examiner

EXPANDABLE CLINCH JOINT PUNCH

TECHNICAL FIELD

The technical field of this disclosure is punches used to form clinch joints in sheet metal parts.

BACKGROUND

Assembly operations for joining aluminum parts and mixed metal parts are being developed to maximize the use of lightweight parts and improve fuel economy. Currently, self-piercing rivets are used to join aluminum and mixed metal part assemblies because they can provide a strong joint between adjacent parts. Self-piercing rivets add weight to the assembly and also add cost that is added to the final product.

Clinch joints are used in some applications but are not as strong as self-piercing rivet joints, particularly in the coach peel orientation. Clinch joints are lighter weight and less expensive than self-piercing rivet joints because they do not require a rivet Clinch joints are not as strong or robust as self-piercing rivets because they are limited by the extent of mechanical interlock that can be achieved between the joined panels.

The above problems and challenges and others are addressed by this disclosure as summarized below.

SUMMARY

This disclosure provides a new clinch joint punch and a new method of forming a clinch joint that increases the extent of mechanical interlock for clinch joints. Increasing the mechanical interlock results in higher joint strength. The total number of clinch joints in an assembly having multiple clinch joints may be reduced because the strength of each clinch joint is increased.

According to one aspect of this disclosure, a clinch punch is disclosed for joining multiple panels with a clinch joint. The punch comprises a core having a first cam surface and an sleeve defining an opening. The sleeve has a plurality of teeth that each includes a second cam surface. An actuator drives the core and sleeve into a plurality of panels. The core is moved within the sleeve by the actuator with the first cam surface engaging the second cam surfaces to move the teeth outwardly to join the panels together.

According to other aspects of the punch, a spring may operatively engage the core and the sleeve to bias the core away from the panels and disengage the first cam surface from the second cam surfaces to move the teeth inwardly to retract the punch from the panels. The core may have a head on a first end that is engaged by the actuator and the spring may be disposed between the sleeve and the head with the spring being compressed as the teeth are moved outwardly and expanded as the teeth are moved inwardly.

The core may be a cylindrical member having a leading end that includes a partially conical surface and the second cam surfaces on the teeth may each have a contact surface that is disposed at a complementary angle to the first cam surface.

Alternatively, the sleeve may include a plurality of separate jaws that are retained on the core by a connector that secures the jaws to the core. The connector may be attached to the core with a lost motion connection that allows the core to move to a limited extent relative to the jaws. The connector may be a fastener and the jaws may each define an opening that receives the fastener and the core may define a slot that is elongated in a direction that the core is moved by the actuator.

The punch may further comprise a spring operatively engaging the jaws to bias the jaws toward the core, and wherein the jaws are driven apart by the first cam surface engaging the second cam surfaces. The spring may be a first spring attached to a first end of the fastener and a second spring attached to a second end of the fastener. The first and second springs bias the teeth toward the core with the first cam surface engaging the second cam surface to move the teeth away from the core.

According to another aspect of this disclosure a method is disclosed for forming a clinch joint in a plurality of panels. The method comprises driving a punch assembly including a core and an sleeve having a plurality of teeth into the panels to form a depression in the panels. The teeth are shifted outwardly within the depression in the panels to mechanically interlock the panels.

According to other aspects of the method, the core may have a first cam surface and the sleeve may have a second cam surface and the method may further comprise engaging the first cam surface and the second cam surface to shift the teeth outwardly. The teeth may be projections that extend in a longitudinal direction from the sleeve. The second cam surface may further comprise a plurality of second cam surfaces that are each provided on one of the teeth.

According to an alternative embodiment of the method, the sleeve may further comprise a plurality of jaws that each includes at least one of the plurality of teeth and one of the second cam surfaces.

The method may further comprise shifting the teeth inwardly after mechanically interlocking the panels, and retracting the punch assembly from the depression in the panels. The core may have a first cam surface and the sleeve may have a second cam surface. The method may further comprise engaging the first cam surface and the second cam surface to shift the teeth outwardly, and withdrawing the first cam surface from the second cam surface to shift the teeth inwardly.

The above aspects of this disclosure and other aspects are described in greater detail below with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
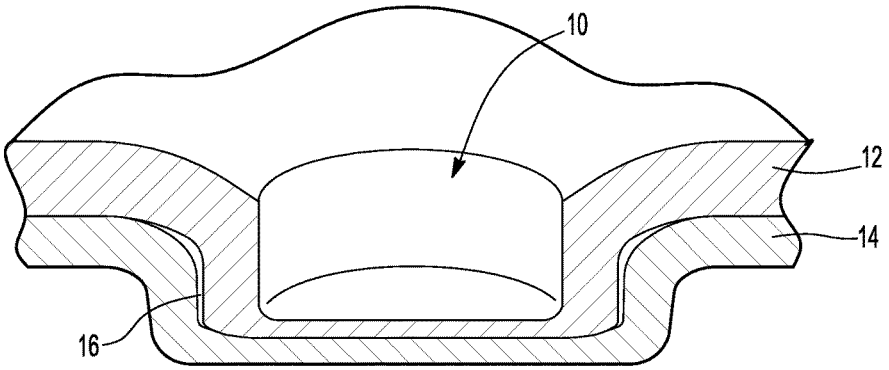
Fig-1 PRIOR ART
FIG. 1 is a fragmentary cross section view of a prior art clinch joint.

Referring to FIG. 1, a clinch joint 10 is shown joining a top panel 12 to a bottom panel 14. The references to top and bottom correspond to the orientation of the panels as illustrated in FIG. 1 and should not be used to interpret the orientation of the clinch joint 10 which may be used to join panels that are in any directional orientation. A mechanical interlock 16 secures the top panel 12 to the bottom panel 14.

Figure 2:
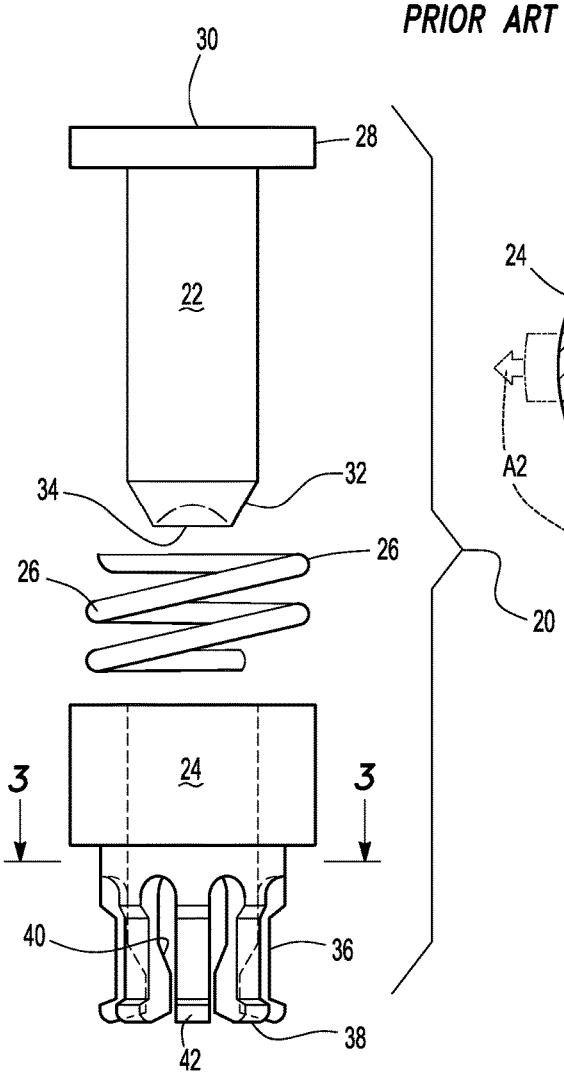
FIG. 2 is an exploded perspective view of a clinch joint punch made according to one exemplary embodiment of this disclosure.

Referring to FIG. 2, a clinch punch assembly 20 is shown to include a core 22 that is received in an sleeve 24, or outer member, and a spring 26, or biasing device. A head 28 is provided on the core 22. The head 28 receives an actuation force, as will be described in greater detail with reference to FIGS. 4 and 5 below.

The head 28 is provided on an inner end 30 of the core 22. The inner end 30 is received and retained in a clinch joint tool (not shown). A cam surface 32 that is a frusto-conical surface is provided at a distal end 34 of the core 22.

The sleeve 24 includes a plurality of fingers 36 that are provided at a leading end 38 of the sleeve 24. A plurality of cam surfaces 40 are provided on each of the fingers 36. The cam surfaces 40 are disposed at a complementary angle to the cam surface 32 of the core 22. Forming surfaces 42 are provided on an outer surface of the fingers 36. The forming surfaces 42 engage the clinch joint 10 in the final stages of forming the clinch joint.

Figure 3:
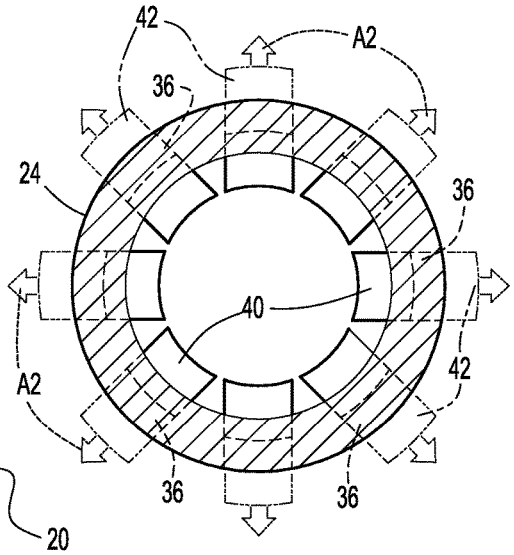
FIG. 3 is a cross section view taken along the line 3-3 in FIG. 2.

Referring to FIG. 3, the sleeve 24 is shown in cross section with the finger 36 partially in phantom to show the fingers in a retracted and an expanded position. The fingers 36 include cam surfaces 40 that are visible within the inner diameter of the sleeve 24. When the cam surface 32 of the core 22 engages the cam surfaces 40, the forming surfaces 42 on the fingers 36 are driven outwardly in the direction indicated by expansion arrows A2.

Figure 5:
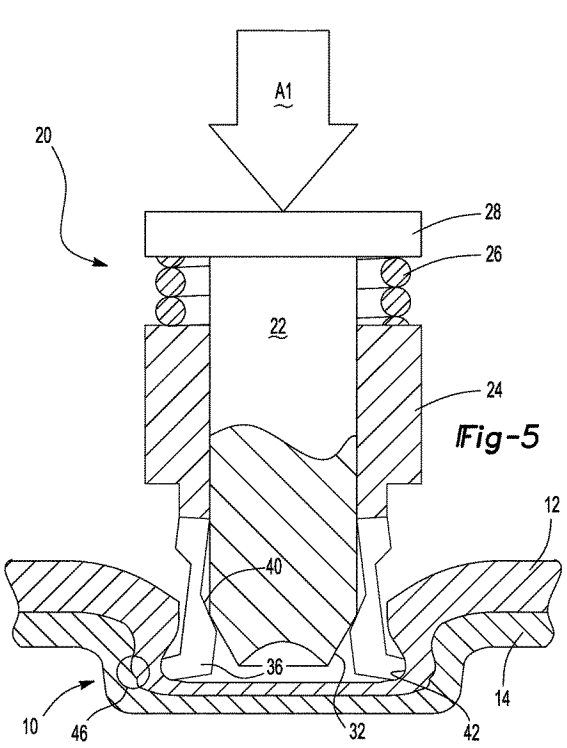
FIG. 5 is a fragmentary cross section view of the clinch joint punch of FIG. 2 illustrating the punch in a second phase of the clinching operation.
Figure 4:
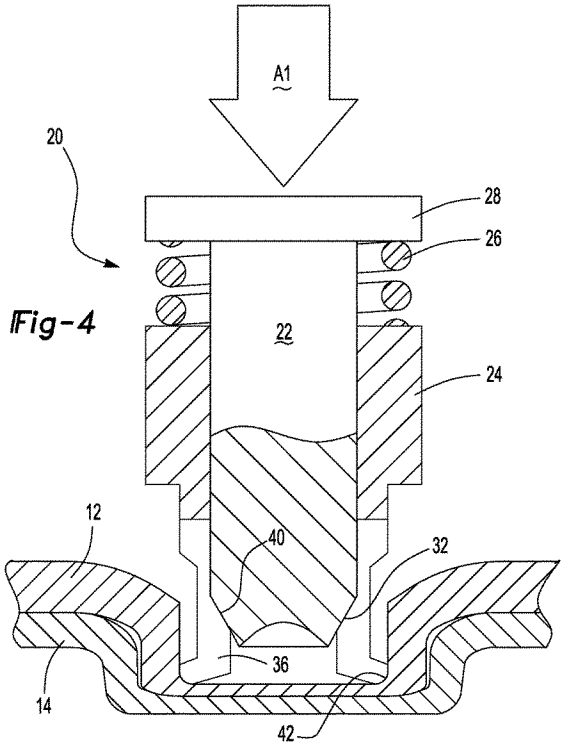
FIG. 4 is a fragmentary cross section view of the clinch joint punch of FIG. 2 illustrating the punch in a first phase of the clinching operation.

Referring to FIGS. 4 and 5, the clinch punch assembly 20 is shown in FIG. 4 in a first stage of the forming process. As shown in FIG. 5, the clinch punch assembly is shown in a second phase in which the mechanical interlock between the top panel 12 and the bottom panel 14 is illustrated.

Referring to FIG. 4, an actuation arrow A1 is shown to represent the force applied to the head 28 of the core 22. The core is driven downwardly, as shown in FIG. 4, to force the cam surface 32 into engagement with the cam surfaces 40 provided on the fingers 36. The forming surfaces 42, as shown in FIG. 4, are in the retracted position.

Referring to FIG. 5, the actuation force arrow A1 is shown after the core 22 is driven into engagement with the fingers 36. The cam surface 32 is driven across the cam surfaces 40 to force the forming surfaces 42 into the top panel 12 to create an enhanced interlock, as shown by the circle 46. The top panel 12 is driven sideways into the bottom panel 14 by the forming surfaces 42. After completion of the enhanced interlock phase shown in FIG. 5, the spring 26 biases the core 22 in an upward direction to provide a return force upon completion of forming the clinch joint. The spring 26 withdraws the core 22 back into the sleeve 24 in the direction opposite arrow A1.

Figure 6:
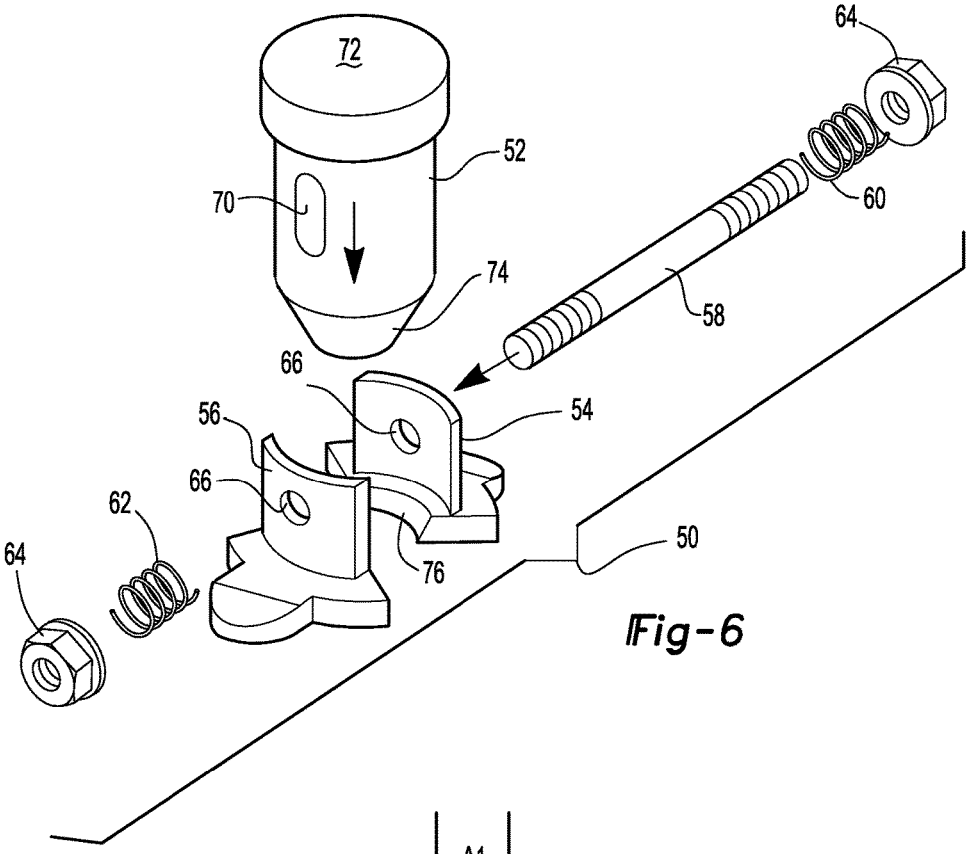
FIG. 6 is an exploded perspective view of the clinch joint punch of FIG. 5

Referring to FIG. 6, an alternative clinch punch assembly 50 is shown in an exploded perspective view. The clinch punch assembly 50 includes a core 52 that is received between a first jaw 54 and a second jaw 56. A threaded shaft 58, or fastener, is assembled with a first spring 60 on an outer side of the first jaw 54 and a second spring 62 received on the threaded shaft 58 on the outer side of the second jaw 56. Nuts 64 retain the springs 60, 62 on the threaded shaft 58. The threaded shaft 58 extends through holes 66 formed in the first jaw 54 and second jaw 56. A slot 70 provides a lost motion connection between the core 52 and the threaded shaft 58. The threaded shaft 58 is inserted through the holes 66 and slot 70. The slot 70 provides a lost motion connection so that the core 52 may be moved initially with respect to the first and second jaws 54 and 56.

The head 72 of the core 52 receives the actuation force A1 and drives the core downwardly, as illustrated. A driving cam surface 74 provided on the core 52 engages the driven cam surface 76 that is provided on the first jaw 54 and second jaw 56.

Figure 7:
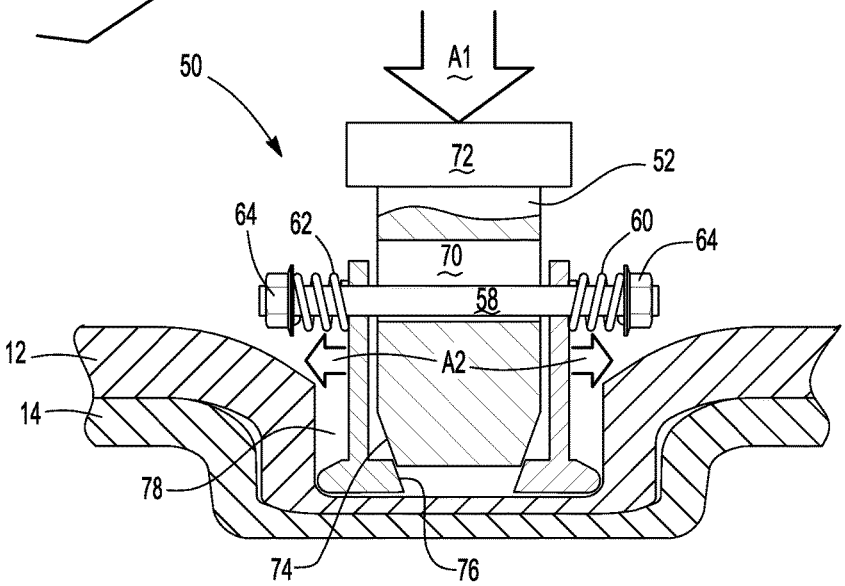
FIG. 7 is a fragmentary cross section view of an alternative embodiment of a clinch joint punch.

Referring to FIG. 7, the alternative clinch punch assembly 50 is shown in a first phase of a clinching operation (corresponding to the phase illustrated in FIG. 4) in which the clinch punch assembly 50 is driven into the top panel 12 that is, in turn, driven into the bottom panel 14. The punch assembly 50 forms a depression 78 in the panels 12, 14. At this point, the threaded shaft 58 is disposed in the lower portion of the slot 70. As the actuation force continues to be applied to the head 72 of the core 52, the core 52 moves relative to the threaded shaft 58 until the top of the slot 70 engages the threaded shaft 58. The driving cam surface 74 engages the driven cam surface 76 to force the jaws apart, as shown by expansion arrows A2. The jaws are forced apart against the force of the first and second springs 60 and 62. When the jaws 54 and 56 are driven in the direction of the expansion arrows A2, an enhanced clinch joint is formed that is similar to the clinch joint shown in FIG. 5 above. The springs 60 and 62 bias the jaws 54 and 56 toward a retracted position to facilitate withdrawing the clinch punch 50 from the clinch joint 10.

While two jaws 54 and 56 are shown, it is anticipated that four or more jaws could be provided with suitable modifications of the clinch punch 50.

While exemplary embodiments are described above, it is not intended that these embodiments describe all possible forms of the disclosure. The words used in the specification are words of description rather than limitation. Changes may be made to the illustrated embodiments without departing from the spirit and scope of the disclosure as claimed. The features of the illustrated embodiments may be combined to form further embodiments of the disclosed concepts.

What is claimed is:

1. A clinch punch comprising:

a core having a first cam surface;

a sleeve defining an opening and having a cylindrical portion and a plurality of teeth each located inboard of the cylindrical portion and including a second cam surface; and an actuator for driving the core and sleeve into a plurality of panels, wherein the first cam surface engages the second cam surfaces thereafter to move the teeth outwardly to join the panels together.

2. The clinch punch of claim 1 further comprising:

a spring operatively engaging the core and the sleeve to bias the core away from the panels and disengage the first cam surface away from the second cam surfaces to move the teeth inwardly to retract the punch from the panels.

3. The clinch punch of claim 2 wherein the core has a head on a first end that is engaged by the actuator, wherein the spring is disposed between the sleeve and the head, and wherein the spring is compressed as the teeth are moved outwardly and expanded as the teeth are moved inwardly.

4. The clinch punch of claim 1 wherein the core has a head on a first end that is engaged by the actuator.

5. The clinch punch of claim 1 wherein the core is a cylindrical member having a leading end that includes the first cam surface that is a partially conical surface and the second cam surfaces on the teeth each have a contact surface that is disposed at a complementary angle to the first cam surface.

6. A clinch punch comprising:

a core having a first cam surface;

a sleeve assembled to the core and having a cylindrical portion extending about an axis and a plurality of teeth located radially inward of an outer surface of the cylindrical portion, each including a second cam surface; and an actuator drives the core and sleeve together into a plurality of panels forming a clinch joint, the core moving within the sleeve, and the first cam surface engaging the second cam surfaces moving the teeth outwardly to radially expand the clinch joint.

* * * * *